US010753556B2

(12) United States Patent
Creusen et al.

(10) Patent No.: US 10,753,556 B2
(45) Date of Patent: Aug. 25, 2020

(54) EASY TO INSTALL AND MAINTAIN EMBEDDED LIGHTING SYSTEM

(71) Applicant: SIGNIFY HOLDING B.V., Eindhoven (NL)

(72) Inventors: Martinus Petrus Creusen, Wijlre (NL); Vincent Stefan David Gielen, Gastel (NL); Peter Johannes Martinus Bukkems, Deurne (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/625,677

(22) PCT Filed: Jun. 18, 2018

(86) PCT No.: PCT/EP2018/066054
§ 371 (c)(1),
(2) Date: Dec. 21, 2019

(87) PCT Pub. No.: WO2019/001997
PCT Pub. Date: Jan. 3, 2019

(65) Prior Publication Data

US 2020/0124242 A1 Apr. 23, 2020

(30) Foreign Application Priority Data

Jun. 26, 2017 (EP) ..... 17177879

(51) Int. Cl.
*F21V 21/00* (2006.01)
*F21S 4/24* (2016.01)
(Continued)

(52) U.S. Cl.
CPC . *F21S 4/24* (2016.01); *F21S 4/28* (2016.01); *F21V 23/06* (2013.01);
(Continued)

(58) Field of Classification Search
CPC .... F21S 4/24; F21S 4/28; F21V 23/06; F21Y 2103/10; F21Y 2115/10; F21Y 2107/70
(Continued)

(56) References Cited

U.S. PATENT DOCUMENTS 8,628,229 B1 * 1/2014 Mc Neil ..... F21V 15/01 362/249.02
9,115,858 B2 8/2015 Levante et al.
(Continued)

FOREIGN PATENT DOCUMENTS

DE 202012100952 U1 4/2012
DE 202012011550 U1 4/2013
WO 2008114200 A1 9/2008

*Primary Examiner* — Ali Alavi
(74) *Attorney, Agent, or Firm* — Daniel J. Piotrowski

(57) ABSTRACT

A light strip and a method for installing a light strip are provided. The light strip is adapted to be installed in a conduit. The light strip comprises a substrate including a flexible material, a plurality of light emitting diodes, LEDs, arranged on the substrate, a reinforcing element arranged at the substrate to rigidify the light strip such that the light strip is adapted to be pushed or pulled through the conduit, and a connecting means arranged at end of the light strip and configured to, at least temporarily, connect a puller wire for pulling the light strip through the conduit.

12 Claims, 5 Drawing Sheets

(51) Int. Cl.

| | |
|---|---|
| ***F21S 4/28*** | (2016.01) |
| ***F21V 23/06*** | (2006.01) |
| *F21Y 103/10* | (2016.01) |
| *F21Y 115/10* | (2016.01) |
| *F21Y 107/70* | (2016.01) |

(52) U.S. Cl.
CPC ..... *F21Y 2103/10* (2016.08); *F21Y 2107/70* (2016.08); *F21Y 2115/10* (2016.08)

(58) Field of Classification Search
USPC ..... 362/249.01, 249.04, 8
See application file for complete search history.

(56) References Cited

U.S. PATENT DOCUMENTS

| | | | | |
|---|---|---|---|---|
| 2003/0193803 | A1* | 10/2003 | Lin | F21S 4/24 362/249.04 |
| 2010/0008090 | A1* | 1/2010 | Li | F21S 4/24 362/249.03 |
| 2014/0334142 | A1* | 11/2014 | Levante | F21V 23/06 362/222 |
| 2016/0176336 | A1 | 6/2016 | Hoek et al. | |
| 2017/0072423 | A1 | 3/2017 | Vogtner et al. | |

* cited by examiner

EASY TO INSTALL AND MAINTAIN EMBEDDED LIGHTING SYSTEM

CROSS-REFERENCE TO PRIOR APPLICATIONS

This application is the U.S. National Phase application under 35 U.S.C. § 371 of International Application No. PCT/EP2018/066054, filed on Jun. 18, 2018, which claims the benefit of European Patent Application No. 17177879.8, filed on Jun. 26, 2017. These applications are hereby incorporated by reference herein.

FIELD OF THE INVENTION

The present invention generally relates to the field of installing light strips in buildings or the like.

BACKGROUND OF THE INVENTION

Flexible LED strips find applications in the home segments, enabling, for example, unobtrusive cove lighting or embedding light strips in construction elements or furniture. However, for professional applications there may be uncertainty in the amount of time required for installing and maintaining a lighting installation.

Commonly, light strips are glued to an underlying substrate, using for example double sided adhesive tape. As easy as this seems, there are several drawbacks of installing light strips using double sided adhesive tape. For example, the adhesive tape only sticks well when the underlying surface is smooth and clean and removing a light strip mounted using tape may be very difficult. Therefore, maintaining or upgrading a light strip installation may be very difficult.

Another option for mounting LED strips is based on extruded aluminum profiles mounted using screws or click features. However, using aluminum profiles may not be very easy to scale and does not give as much flexibility as using tape.

Hence, there is a need for a system, a method and components providing an improved installation of LED strips.

SUMMARY OF THE INVENTION

An object of the present disclosure is therefore to mitigate some of the drawbacks described above. To achieve this, a light strip, a kit and a method as defined in the independent claims are provided. Further embodiments are defined in the dependent claims.

Hence, according to a first aspect, a light strip adapted to be installed in a conduit is provided. The light strip comprises a substrate including a flexible material and a plurality of light emitting diodes, LEDs, arranged on the substrate. The light strip may further comprise a reinforcing element arranged at the substrate to rigidify the light strip such that the light strip is adapted to be pushed or pulled through the conduit. The light strip may comprise a connecting means arranged at an end of the light strip, and configured to, at least temporarily, connect (or attach) a puller wire for pulling the light strip through the conduit.

According to a second aspect, a method for installing a light strip is provided. The method comprises arranging a puller wire in a section of a conduit in which the light strip is to be installed, the conduit being mounted in a permanent structure such that the puller wire extends through the section of the conduit. The method may further comprise connecting, at an end of the section of the conduit, the puller wire to an end of the light strip, and pulling the puller wire through the conduit such that at least a part of the light strip is arranged in the section of the conduit.

With this light strip and method, a light strip may be installed in a conduit or maintained by pulling the light strip through a conduit with the help of a draw wire (or puller wire). The conduit may, for example, be pre-mounted in a building, outdoors, or somewhere else where it is desired to have a light strip installed.

Installing a light strip in a conduit according to the method allows for easy removal of the light strip, and it may be easily replaced, since the light strip is not attached to the conduit. For example, a light strip that has reached end of life may be replaced, or the light strip may be replaced by one with reduced power consumption.

It has been realized that by installing a light strip in a conduit of a permanent structure, such as a building or simply the wall of a room, by pulling it through the conduit with the help of a draw wire, the light strip can be easily installed, maintained or removed. For example, the conduit does not have to be upgraded when the light strip is upgraded or removed, as the light strip is separate from the conduit (the conduit being embedded e.g. in the permanent structure and the LED strip being inserted in it).

This method of installation is also advantageous in that the light strip may be pulled through a conduit for example installed through a wall, a ceiling or other permanent structure. This allows for more flexibility in the installation as compared to previous light strips.

For example, the conduit may be placed in a tiled wall or floor in a home. As tiles may have a longer lifetime than light strips, having the light strip removable from the conduit allows for upgrading the light strip when needed by pulling the light strip out of the conduit. Another light strip, or a new light strip with similar characteristics, may then be installed with the method described above.

The conduit may guide the light strip during installation to ensure a correct positioning. The conduit may also protect the light strip from, for example, dust, dirt, water or weather once installed.

To enable the pulling of a light strip over greater lengths, the light strip may have one or more reinforcing elements. The reinforcing elements may rigidify the light strip or the substrate, i.e. make it less flexible or harder. With the reinforcing element, the risk of the light strip being stretched too much or breaking is decreased.

In the present specification, the term "conduit" may include any conduit or tube suitable for pulling a light strip through it. The conduit may be straight or bent, and stretch over a long or a short distance. The conduit may be pre-installed or permanently installed in a permanent or fixed structure, such as in the wall or ceiling of a building or vehicle, or a structure outdoors such as a bike lane or other public space.

It will be appreciated that a "flexible material" in the following means a material with elastic properties.

A "draw wire" or a "puller wire" may include any type of wire that can be pulled through a conduit. The draw wire may also be adapted for pushing through the conduit such that it may be connected to the light strip at another end of the conduit than the end at which the draw wire was pushed.

A "reinforcing element" may be any element suitable for reinforcing the substrate, i.e. making it less flexible. The reinforcing element may be located at the substrate, and may, for example, be embedded in the substrate, arranged on the substrate or partly surround the substrate.

The term "rigidify" may be understood as decreasing the flexibility of the light strip. For example, by having a reinforcing element, the substrate may be less flexible than by its own. However, the substrate may still include a flexible material and show certain elasticity so that the light strip may be pulled or pushed through a conduit, even when not straight.

According to an embodiment, the reinforcing element may be a wire embedded in the substrate. The wire may comprise metal or other materials, such as composite materials, that are more rigid than the substrate. Several embedded metal wire may be used to reinforce the substrate. Any type of metal wire harder than the substrate may be used, however, the substrate may still include a flexible material and show certain elasticity so that the light strip may be pulled or pushed through a conduit, even when not straight. The metal wire may, for example, be embedded on the side of the substrate, at the middle of the substrate or at another position. The metal wire does not have to be embedded at the full length of the light strip, but it may be.

Using one or more metal wires to rigidify the substrate (and thereby the light strip) allows for pulling the wire over longer distances even if there are bends and angles. Having a more rigid light strip may also decrease the risk of tear in the light strip, or to stretch it too much when pulling.

Further, a metal wire does only take up a small amount of space, thereby allowing for a more compact light strip.

According to an embodiment, the metal wire may be adapted to serve as a low Ohmic interconnection means for electrical connection of the LEDs.

Using the metal wires as an electrical connection may enable lower voltage losses. In this way, higher output LEDs and light strips which require relatively high LED currents may be used.

According to an embodiment, the reinforcing element may be a transparent semi-rigid harness, wherein the harness is more flexible when pulled than when pushed through the conduit. By harness it may be meant a structure at least partly enclosing the light strip or the substrate.

The present embodiment may facilitate the installation of the light strip in the conduit, as the light strip may be both pushed and pulled. It may be beneficial to have the light strip rigid to enable pushing it through the conduit. When pulling the light strip, it may be beneficial to have it less rigid, but still protected by the harness, so that it can be pulled through bends and angles.

According to one embodiment, the reinforcing element may comprise a plurality of rigid parts and a plurality of hinges. The hinges may be arranged to connect the rigid parts and may be arranged in alternating directions in a plane. This may also be called a polymeric structure. For example, the substrate is flexible in one direction (for example up and down) and not flexible in another (for example sideways).

In this way, the light strip may be prevented from twisting when pushed or pulled through a conduit. Keeping the light strip from twisting may decrease the risk that the light strip is turned in an incorrect direction, and may allow for improved optical performance.

In some embodiments, the reinforcing element may be wider than the substrate, and thereby have portions extending outside of the substrate. The extending portions may be arranged to act as guiding features to minimize friction and help guiding the light strip in the conduit. Optionally, the reinforcing element may comprise another guiding feature.

A guiding feature of the light strip may be adapted to match a guiding feature of the conduit to further facilitate the installation of the light strip in the conduit.

According to one embodiment, the connecting means may be a clamping mechanism, a wire loop or an opening in the substrate. Other connecting means may be envisaged, such as glue or a snap-lock connecting means.

According to one embodiment, a light installation kit comprising a light strip, and a conduit for encapsulating and guiding the light strip is provided. The conduit may be at least partly transparent for allowing light from the plurality of LEDs to pass, which allows for light from the LEDs arranged on the substrate to pass through the conduit. Accordingly, the conduit may be fully transparent or comprise areas where the light may not pass, allowing for further flexibility of how the light strip may be arranged.

According to an embodiment, a cross section of the conduit may be asymmetrical. Asymmetrical may, for example, be oval, rectangular, polygonic, or another shape that is not entirely symmetric.

With an asymmetrical conduit, the light strip may be guided in the circuit with a decreased risk of being twisted when pulled through the conduit. This decreases the risk for the LEDs being turned the wrong way. The present embodiment therefore ensures that the light strip emits light in a correct light output direction. The asymmetrical cross section may also help in guiding the light strip into the correct position to ensure a correct light output.

According to an embodiment, the cross section of the conduit may be rectangular. For example, the rectangular cross section may have a shorter side that is shorter than the width of the light strip and a longer side which is long enough to accommodate the light strip.

As the light strip may be relatively flat, a rectangular cross section of the conduit may further prevent the risk of the light strip being incorrectly positioned or twisted when being pulled through the circuit.

According to an embodiment, a light output area of the conduit may have an optical beam shaping function. That is, the conduit may have one or more light output areas, and one or more of them may have an optical beam shaping function. The present embodiment may ensure that a correct light output from the light strip is provided, without having to mount the beam shaping object onto the strip, thereby allowing for a more compact and easier to install light strip.

According to an embodiment, the light output area may have a Fresnel shape. With a Fresnel shape at the light output area the light may be directed in a particular direction, while still keeping the light output area relatively thin.

According to an embodiment, the light output area may have at least one of a reflector, a conventional lens or a TIR lens, which allow for guiding the light, while keeping the light strip relatively compact.

According to an embodiment, the conduit may be mounted in a permanent structure. The permanent structure, or fixed structure, may, for example, be a wall, floor, ceiling, window or another area in a building or vehicle, a structure outdoors such as a bike lane or another public space.

As the lifetime of such a permanent structure may be longer than the lifetime of a light strip, it is advantageous that the light strip may be easily maintained or removed. If the light strip would break or need maintenance, it can be removed and replaced without having to change the conduit, thereby allowing for incorporating light into such a structure, and decreasing the need for rebuilding.

In an embodiment of the second aspect, the method may further comprise connecting the light strip to a power source in a junction box located in the permanent structure at one end of the section of the conduit.

The junction box may be easily accessible, and allow for removing, installing and replacing light strips. The junction box may, for example, be embedded in a ceiling or buried in a plaster of a wall. The junction box, and the conduit connecting to it, may not have to be close to the portion of the conduit at which light is emitted by the light strip, but it may need to be connected to the portion in order for the light strip to be pulled through or out of the conduit.

The junction box may also comprise a power supply that the light strip may be connected to. The junction box may also serve as a junction box for other conduits, and thereby as a power supply for other light strips. There may be a centralized box for multiple light strips, further facilitating maintenance and installation, since the power supply does not need to be set up for each light strip.

It will be appreciated that any of the features in the embodiments described above for the light strip according to the first aspect may be combined with the method according to the second aspect of the inventive concept disclosed herein, and vice versa.

Further objectives of, features of, and advantages with the present inventive concept will become apparent when studying the following detailed disclosure, the drawings and the appended claims. Those skilled in the art will realize that different features of the present inventive concept can be combined to create embodiments other than those described in the following.

BRIEF DESCRIPTION OF THE DRAWINGS

The above, as well as additional objects, features and advantages of the present inventive concept, will be better understood through the following illustrative and non-limiting detailed description of preferred embodiments of the present inventive concept, with reference to the appended drawings. In the drawings like reference numerals will be used for like elements unless stated otherwise.

All the figures are schematic, not necessarily to scale, and generally only show parts which are necessary in order to elucidate the embodiments, wherein other parts may be omitted.

DETAILED DESCRIPTION OF EMBODIMENTS

Detailed embodiments of the present inventive concept will now be described with reference to the drawings. The present inventive concept may, however, be embodied in many different forms and should not be construed as limited to the embodiments set forth herein; rather, these embodiments are provided by way of example so that this disclosure will convey the scope of the inventive concept to those skilled in the art.

Figure 1A:
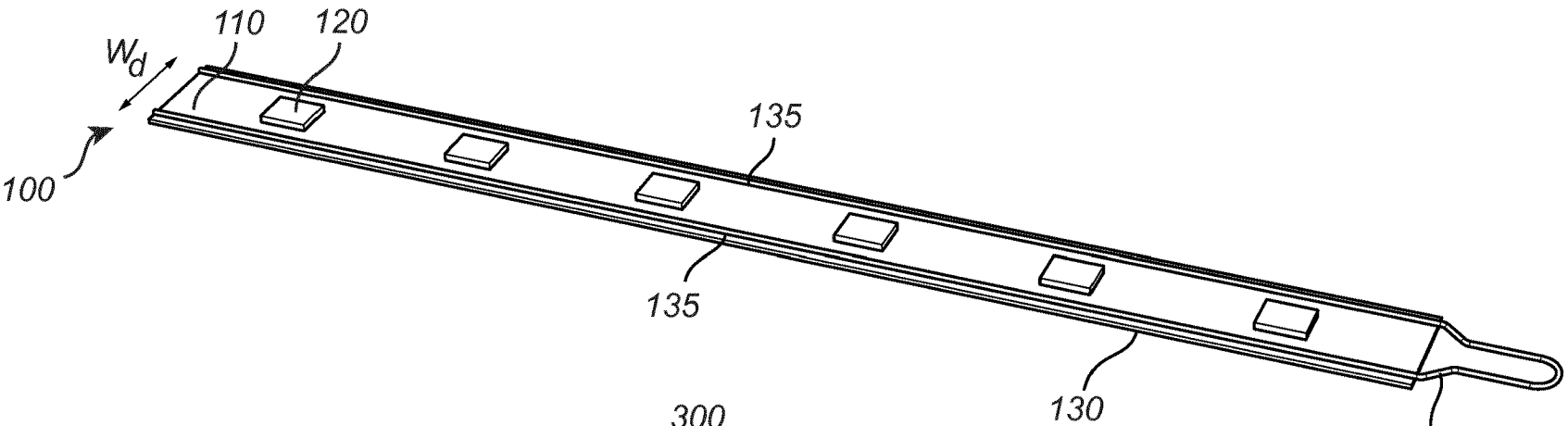
FIGS. 1A-1C are schematic views of a light strip, a conduit and a pull wire according to an embodiment.

Embodiments of the present inventive concept generally relate to a method and a light strip suitable for installation in a conduit. A light strip 100 will be described with reference to FIG. 1A. The light strip 100 may comprise a flexible substrate 110 and a plurality of light emitting diodes 120, LEDs, arranged on the substrate 110. The light strip may have a width WI.

The flexible substrate 110 may be a material with elastic properties, for example an elastomer, polyvinyl chloride (PVC), polycarbonate (PC), polymethylmethacrylate (PMMA), polyurethane (PUR), silicone flexible polymers, such as a combination of PC and silicone.

The light strip 100 may also comprise a reinforcing element 130. The reinforcing element 130 may be wires 135, comprising metal or other materials that are more rigid than the substrate, as illustrated in FIG. 1. The metal wires 135 may also serve as a low Ohmic interconnection means for electrical connection of the LEDs 120. The metal wires 135 may include a metal or a mixture of metals or other compounds such that the electrical conductivity or resistance of the wires is suitable for connection of the LEDs 120.

Other reinforcing elements may be envisaged as alternatives or in combination with metal wires, for example as will be described with reference to Figure SA and FIG. 5B.

The light strip 100 may also comprise a connecting means 140, such as a clamping mechanism, a wire loop or an opening, or another means suitable for connecting a draw wire 200. In the example depicted in FIG. 1A, the connecting means 140 is a wire loop.

The light strip 100 may also comprise means for connecting an electrical power source. The power source may, for example, be a battery or a land power source.

Figure 1C:
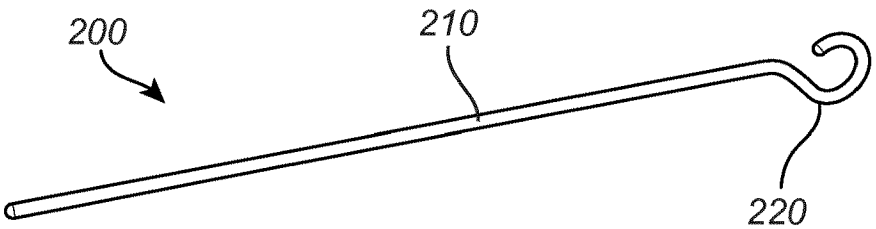
Figure 1B:
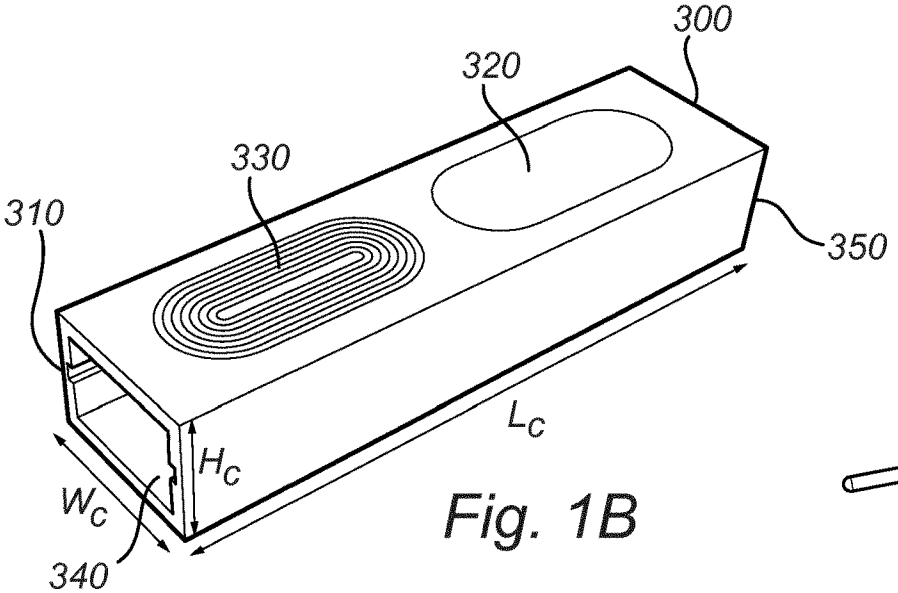

FIG. 1B shows a schematic view of a conduit 300 in which a light strip 100 (such as that described with reference to FIG. 1A) may be installed. The conduit may have a width $W_c$, a height $H_c$ and a length $L_c$. The height $H_c$ may be smaller than the width. The height $H_c$ and the width $W_c$ may be adapted to accommodate a light strip. For example, the height $H_c$ may be smaller than the width of the light strip in order to prevent the light strip from twisting within the conduit 300. The conduit 300 may have two side openings 340, 350 through which a draw wire and a light strip may be drawn.

The conduit 300 may, for example, be made of a plastic material, e.g. PVC, PC, PMMA, or glass. The conduit 300 could be made of an extrusion of two or more materials with an optical transparent portion and a reflective portion. If the conduit comprises glass, a guiding structure may be used to reinforce it. The conduit 300 may be suitable for installation in a fixed or permanent structure, i.e. be permanently mounted.

The conduit 300 may have one or more light output areas 320, 330 to allow the light from the LEDs of a light strip installed in the conduit to pass. The light output area 320 may be transparent or made of a diffuse material, or the light output area 330 may have a beam shaping function. The beam shaping function may, for example, be a Fresnel shape, a reflector, a conventional lens or a TIR lens, or another beam shaping function for directing the light from the LEDs of a light strip installed in the conduit.

The conduit 300 may also have a guiding feature 310 for guiding the light strip into an intended position within the conduit. The guiding feature may be a recess 310, or it may be an extending portion (not shown in the drawings). The guiding feature 310 of the conduit may be adapted to match a guiding feature of the light strip 100.

The conduit 300 may have an asymmetrical cross section. The cross section may, for example, be rectangular, oval, a polygon, or another shape. The asymmetrical cross section may help guiding a light strip when it is being pulled through the conduit 300, and may help reduce the risk of twisting or displacing the light strip.

When installing the light strip 100 in a conduit 300, a puller wire 200 or draw wire 200 may be used (which may be the same type of wire, depending on its function) as shown in FIG. 1C. A draw wire 200 may comprise a wire 210 and a connecting means 220. The wire 210 may, for example, be a wire or a string. The wire or string may be made of metal, plastics, or another material. The draw wire 200 may be pushed through a conduit 300 (such as the one described with reference to FIG. 1B) through an opening at one end of the conduit 300, for example opening 340, such that one end of the draw wire exits the conduit through another opening, for example opening 350. The draw wire may then be connected to a light strip 100 and then pulled back through the conduit 300. The draw wire 200 may therefore be longer than the conduit 300.

The connecting means 220 may be any connecting means suitable for connecting the light strip 100 to be installed. Some examples are a hook, a clamp, an opening or an end to which the connecting means of the light strip 100 can be connected.

The draw wire 200 may also have a reinforcing element, such as the ones described with reference to FIG. 5A and FIG. 5B.

Figure 2:
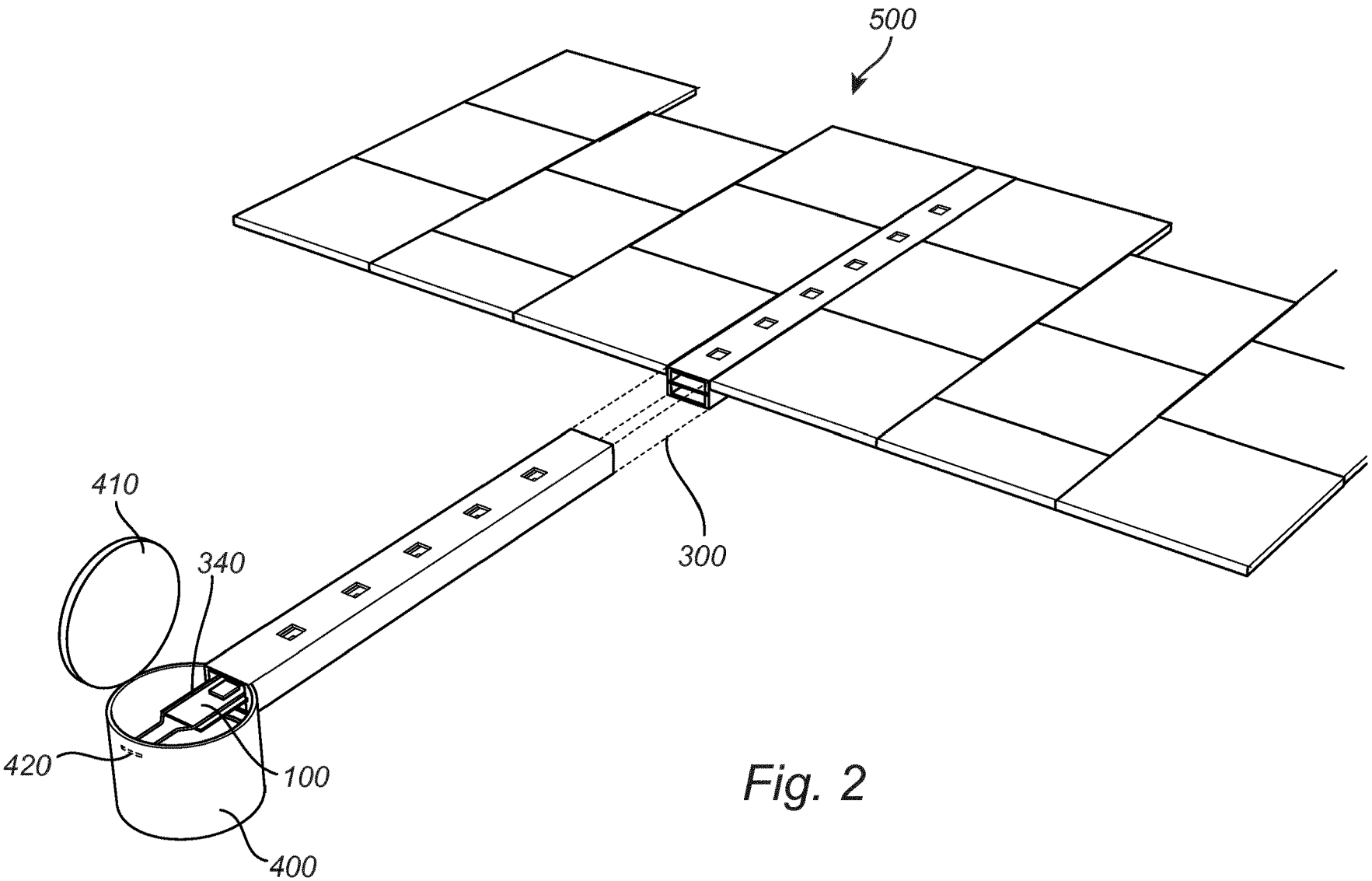
FIG. 2 is a schematic view of a conduit installed in a permanent structure according to an embodiment.

As an illustrative example, an arrangement 500 of a conduit will be described with reference to FIG. 2.

The conduit 300 may be installed in a fixed or permanent structure, i.e. the conduit 300 may be permanently installed. That is, the conduit 300 may be arranged to not be movable relative to the permanent structure. In this example, the permanent structure is a tiling arrangement of a floor in a room. The arrangement comprises tiles 440 and the conduit 300 arranged between two lines of tiles. The conduit 300 may be arranged to have two ends 340 (the second one not shown in the figure) which are accessible for installing, maintaining or removing a light strip 100. The conduit 300 may be arranged so that at least a part of a light strip 100 arranged in the conduit 300 will be visible, i.e. at least some of the light generated by the LEDs 120 of the light strip 100 will pass through the conduit 300. The light output areas of the conduit 300 may be arranged so that light that may pass through them.

As the conduit may not be optically transparent over the whole length, the LED strip may be commissioned such that only the LEDs in the areas of the conduit that allow light to pass out, i.e. close to the light output areas or the transparent or diffuse areas of the conduit, are operational. In one example, this may be done automatically by embedding a light sensor and bypass-switches in the light strip which measure the amount of light reflected inside of the conduit.

At one or more ends or openings of the conduit 300 there may be a junction box. The junction box 400 may be arranged in the same room as the room in which light is to be provided by the light strip, or it may be arranged elsewhere, for example in another room to which the conduit 300 extends. For example, the junction box may be embedded in the ceiling of a room, or it may be buried in a plaster of a wall.

The junction box 400 may connect several conduits. The junction box 400 may be adapted to house a power source 420 to which the light strip 100 may be connected. The junction box 400 may also comprise a lid 410 for covering the opening of the junction box 400. A junction box may be arranged at one end or both ends of the conduit 300.

Figure 3:
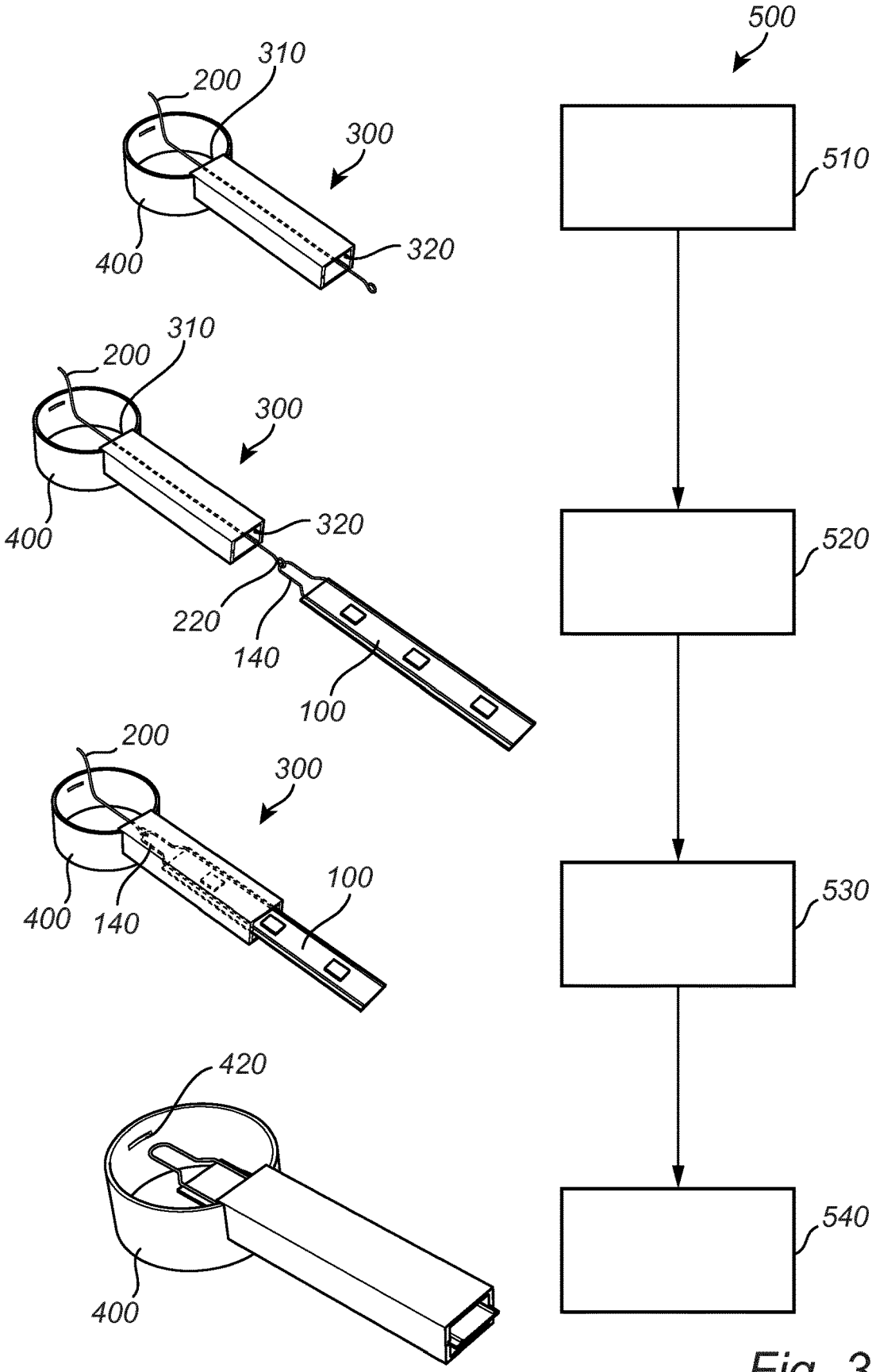
FIG. 3 is an overview of a method for installing a light strip in a conduit according to an embodiment.

A method 500 for installing a light strip 100, according to an embodiment, will be described with reference to FIG. 3.

The method 500 may comprise a step of arranging 510 a draw wire 200 in a section of a conduit 300 in which a light strip 100 is to be installed. The conduit 300 may be mounted in a permanent structure, and it may have a junction box 400 at an end or opening through which the draw wire 200 may enter or exit the conduit 300. The draw wire 200 may be pushed through the section of the conduit 300 at another end 310 so that it exits on one end 320 and a portion of the draw wire 200 is arranged in the section of the conduit 300.

The method 500 may also comprise a step of connecting 520 the draw wire 200 to a light strip 100 at one end 320 of the conduit 300. The connecting may be performed with a connection means 220 of the draw wire 200 and a connection means 140 of the light strip 100. The connection means 220 of the draw wire 200 and the connection means 140 of light strip 100 have been described with reference to FIG. 1A and FIG. 1B.

The method 500 may also comprise pulling 530 the draw wire 200, and thereby the light strip 100 since they are connected via the connection means 140, 220, so that at least a part of the light strip 100 is arranged in the section of the conduit 300.

If the section of the conduit 300 in which the light strip 100 has been inserted has a junction box 400 at one of its ends, the method 500 may further comprise connecting 540 the light strip 100 to a power source 420 in a junction box 400 located at one end of the section of the conduit 300. The junction box 400 with the power source 420 may be located at either end of the section of the conduit 300.

If the section of the conduit 300 does not have a junction box 405 at either end of it, the method 500 may comprise connecting 540 the light strip 100 to a power source in or at one end of the conduit 300. For example, the light strip 100 may be connected to a power source arranged within a conduit 300, another light strip in another section of the conduit 300 or another electrical power source at an end of the section of the conduit 300.

Figure 4:
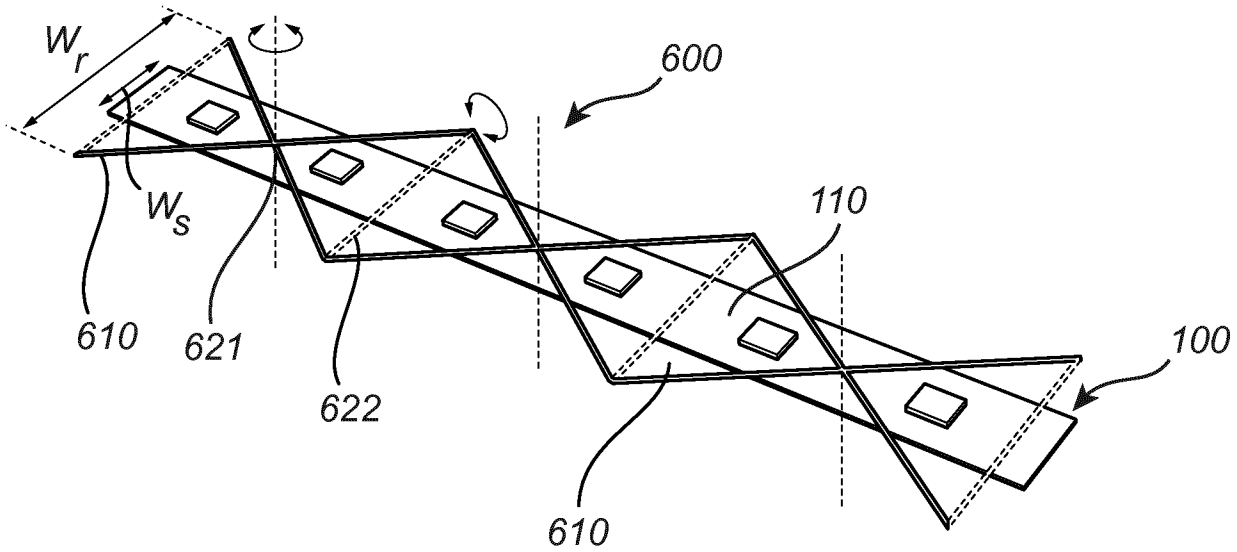
FIG. 4 is a schematic view of a reinforcing element according to an embodiment.

With reference to FIG. 4, a reinforcing element 600 of a light strip 100 is described.

The reinforcing element 600 may comprise a plurality of rigid parts 610 and a plurality of hinges 621, 622. The hinges 621, 622 may be arranged to connect the rigid parts 610 and may be arranged in alternating directions. For example, the hinges 621 may allow for movements in the same plane as the light strip, or the hinges 622 may allow for movements orthogonal to the plane of the light strip. The hinges 621 may be rotated 90 degrees in relation to the hinges 622, i.e. the light strip 100 may be bent or moved in one direction as allowed by the hinges 621, and the light strip 100 may be bent or moved in another direction as allowed by the hinges 622, where the two directions may be orthogonal. It is not necessary that the two directions are orthogonal, also other angles are envisaged. The reinforcing element 600 may also comprise more hinges which allow movements in other directions, and the hinges can be arranged so that the light strip may bend in any number of directions.

The width $W_r$ of the reinforcing element 600 may be smaller than the width $W_s$ of the flexible substrate 110. Alternatively, it may extend beyond the side of the substrate 110. The extending portions may form a guiding feature of the light strip. The guiding feature may be adapted to match a guiding feature of a conduit in which the light strip is to be installed.

The plurality of rigid parts 610 may make the substrate 110 more rigid and prevent it from twisting. The hinges 621,

622 may allow the substrate and the rigid parts 610 to move in predetermined directions. The predetermined directions may be in one plane, for example orthogonal to a line along the largest area of the substrate, or in several planes, for example orthogonal and parallel to a line along the largest area of the substrate 110.

The rigid parts 620 may be flat, so as to not increase the size of the light strip 100 substantially.

The reinforcing element 600 may be embedded in the substrate 110 or it may be arranged on one side of the substrate 110.

The reinforcing element 600 may be used in combination with other reinforcing elements, such as metal wires, or the reinforcing element 600 may be used as the only reinforcing element.

It will be appreciated that the draw wire may also be equipped with a reinforcing element such as described with reference to FIG. 4 in order to prevent the draw wire from twisting or to facilitate the introduction of the draw wire in the conduit.

Figure 5A:
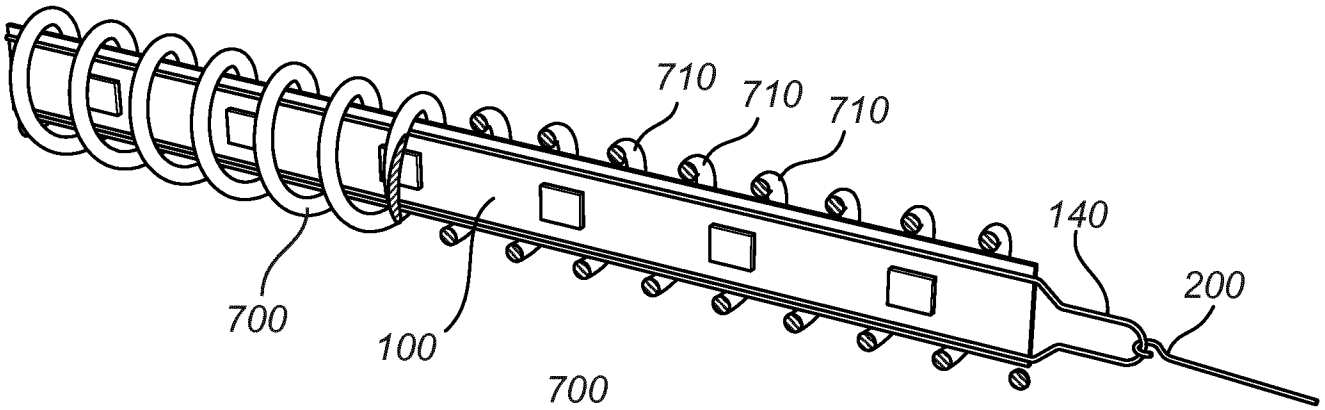
FIGS. 5A-5B are schematic views of a reinforcing element according to an embodiment.
Figure 5B:
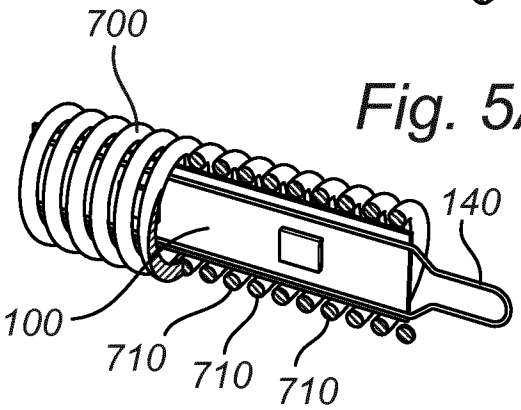

With reference to FIGS. 5A and 5B, an alternative embodiment of a reinforcing element for a light strip is described.

FIGS. 5A and 5B show a reinforcing element which may be a transparent semi-rigid harness 700. The harness 700 may be flexible, as shown in Figure SA, when pulled and rigid, as shown in FIG. 5B, when pushed, for example, through a conduit (not shown in FIGS. 5A and 5B. The harness 700 may comprise a structure such that the harness parts 710 may connect and stabilize when pushed together and be stretched out and disconnected when pulled, thereby allowing for flexibility.

The harness 700 may be used to when pulling the light strip 100 with a draw wire 200 through a conduit. However, it may also be used to push the light strip 100 through a conduit instead of using a draw wire 200, as the light strip 100 may stabilize when being pushed.

The harness 700 may also be used for a draw wire 200 in the same way as for the light strip 100, making it easier to push the draw wire 200 through a conduit.

The person skilled in the art realizes that the present invention by no means is limited to the embodiments described above. On the contrary, many modifications and variations are possible within the scope of the appended claims.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A light strip adapted to be installed in a conduit (300), the light strip comprising:

a substrate including a flexible material;

a plurality of light emitting diodes, LEDs, arranged on the substrate;

a reinforcing element arranged at said substrate to rigidify the light strip such that the light strip is adapted to be pushed or pulled through said conduit; and a connecting means arranged at an end of the light strip and configured to, at least temporarily, connect a puller wire for pulling the light strip through the conduit, wherein the reinforcing element comprises a plurality of rigid and a plurality of hinges; wherein the hinges are arranged to connect the rigid parts and are arranged in alternating directions in a plane.

2. The light strip of claim 1, wherein the reinforcing element further comprises a metal wire embedded in the substrate.

3. The light strip of claim 2, wherein the metal wire is adapted to serve as a low ohmic interconnection means for electrical connection of the LEDs.

4. The light strip of claim 1, wherein the reinforcing element further comprises a transparent semi-rigid harness, wherein the harness is more flexible when pulled than when pushed through said conduit.

5. The light strip of claim 1, wherein the connecting means is a clamping mechanism, a wire loop or an opening in the substrate.

6. A light installation kit comprising:

a light strip according to claim 1;

a conduit for encapsulating and guiding the light strip, the conduit being at least partly transparent for allowing light from the plurality of LEDs to pass.

7. The kit according to claim 6, wherein a cross section of the conduit is asymmetrical.

8. The kit according to claim 6, wherein the cross section of the conduit is rectangular.

9. The kit according to claim 6, wherein a light output area of the conduit has at least one of an optical beam shaping function, a Fresnel shape, a reflector, a conventional lens or a TIR lens.

10. The kit according to claim 6, wherein the conduit is mounted in a permanent structure.

11. A method for installing a light strip according to claim 1, comprising:

arranging a puller wire in a section of a conduit in which the light strip is to be installed, the conduit being mounted in a permanent structure, such that the puller wire extends through the section of the conduit;

connecting, at an end of the section of the conduit, the puller wire to an end of the light strip;

pulling or drawing the puller or draw wire through the conduit such that at least a part of the light strip is arranged in the section of the conduit.

12. The method of claim 11, further comprising:

connecting the light strip to a power source in a junction box located in said permanent structure at one end of the section of the conduit.

* * * * *